United States Patent [19]

Turzillo

[11] 4,027,491

[45] June 7, 1977

[54] COMPOSITE EARTH DRILLING AUGER AND METHOD OF INSTALLING SAME IN SITU

[76] Inventor: Lee A. Turzillo, 2078 Glengary Road, Akron, Ohio 44313

[22] Filed: Jan. 27, 1975

[21] Appl. No.: 544,402

Related U.S. Application Data

[63] Continuation of Ser. No. 441,079, Feb. 11, 1974, abandoned.

[52] U.S. Cl. ..... 61/53.56; 61/53.5

[51] Int. Cl.[2] ..... E02D 5/30; E02D 5/32

[58] Field of Search ..... 61/53.5, 53.52, 56, 61/56.5, 53, 53.56; 249/51; 264/31, 32

[56] References Cited

UNITED STATES PATENTS

| | | | |
|---|---|---|---|
| 839,954 | 1/1907 | Raymond | 61/53.52 |
| 996,688 | 7/1911 | Vernon | 61/56 |
| 1,189,108 | 6/1916 | Hildebrand | 61/53.56 |
| 1,258,482 | 3/1918 | Shuman | 61/53.52 |
| 1,563,024 | 11/1925 | Grimaud | 61/56 |
| 3,187,513 | 6/1965 | Guild | 61/53.5 |
| 3,545,214 | 12/1970 | Grazel | 61/53 |
| 3,636,718 | 1/1972 | Keats | 61/53.74 |
| 3,664,139 | 5/1972 | Sexauer | 61/53.74 |
| 3,779,025 | 12/1973 | Godley et al. | 61/56 |
| 3,899,891 | 8/1975 | Kelly et al. | 61/56 |

FOREIGN PATENTS OR APPLICATIONS

| | | | |
|---|---|---|---|
| 1,464,392 | 12/1966 | France | 61/53.52 |
| 1,102,558 | 10/1955 | France | 61/53.52 |
| 1,157,161 | 3/1954 | Germany | 61/53.5 |

*Primary Examiner*—Paul R. Gilliam
*Assistant Examiner*—Alex Grosz
*Attorney, Agent, or Firm*—Donnelly, Maky, Renner & Otto

[57] ABSTRACT

Segmental shell halves of inventive subject matter are adapted to be assembled at an earth situs to form a tubular cavity drilling auger having hollow spiral flighting. The assembled tubular shell including the hollow flighting is filled with fluid, self-hardenable, cementitious material at the situs, and then drilled into the situs to given full cavity depth to be retained in the cavity as an anchored load-bearing pile or like solid column. Any number of units can be preassembled and filled with the cementitious material at a situs, ready for drilling into the earth in convenient, rapid succession, thereby to avoid costly losses experienced heretofore due to workmen and equipment awaiting possible spasmodic delivery of premixed cementitious material, for example. Unassembled hollow shell halves are adapted to be compactly stacked one within another for storage or shipping purposes.

26 Claims, 7 Drawing Figures

COMPOSITE EARTH DRILLING AUGER AND METHOD OF INSTALLING SAME IN SITU

CROSS-REFERENCE TO RELATED APPLICATIONS

This application is a continuation of applicant's copending United States application Ser. No. 441,079, filed Feb. 11, 1974, now abandoned.

BACKGROUND OF THE INVENTION

In the past, for the purpose of installing load-bearing concrete piles in situ, it has been regular practice in the trade to rotate a hollow shafted, spiral-flighted auger into an earth situs to predetermined depth and then to inject fluid cement mortar through the auger shaft while withdrawing the auger, thereby to fill the drilled cavity, after which the cement mortar was allowed to harden as a solid pile column within the drilled cavity. Such prior methods, however, required use of a substantial amount of heavy, pile drilling equipment for handling large augers, and for pumping cement mortar into the augered cavities in the situs. A major problem with use of the prior pile forming methods in general resided in the fact that each pile cavity of a plurality thereof had to be separately drilled in the situs with use of a continuous flight auger, through which fluid cementitious material was pumped into each respective cavity with progressive withdrawal of the auger. Consequently, the usual cement supply trucks were often required to stand idle while the cavities were being drilled, and quite often the drilling work was seriously hampered by delays in arrival of such supply trucks.

SUMMARY OF THE INVENTION

The method and means of the present invention utilizes a novel one use auger-type device to drill a pile cavity in an earth situs, or to drill into a predrilled cavity, the auger device being retained in the cavity as a load-supporting pile body which is, in effect, more than usually anchored within the situs by retention of compressed earth packed along the flighting of the device.

The improved auger type device is adapted for economical use of a tubular or cylindrical shell, comprised of mating half shells of given length, which can be economically formed by known metal stamping methods. The mating shell halves are adapted to be formed with hollow impressions defining external spiral flighting protrusions, which makes it possible to stack or cup like shell halves one within the other, as for convenient storage and shipping purposes. Accordingly, pairs of such mating shell halves can be assembled and secured together, at an earth situs for example, to form a generally tubular auger shaft of required length, and provided with continuous spiral flighting along the same.

Upon assembly and attachment of two such mating shell halves of predetermined length to form a hollow auger shaft, the ends of the shaft may be closed, as by attachment of suitable closure means such as end plates thereto, whereby fluid self-hardenable material may be pumped or fed into the closed shell to fill the hollow of the same, including the hollow portions of the helical flighting of the resultantly formed auger. In this regard, it should be noted that any given number of assembled auger shells of predetermined lengths can be filled with fluid, hydraulic cement mortar, or other self-hardenable cementitious material in quick succession at the situs, for future use with consequent savings in labor and reduction of the usual wasteful presence of idle pile drilling and pumping equipment. In any event, each of the resultantly formed operable augers, with the filler material hardened or hardening therein, is then adapted to be drilled into the earth to the predetermined depth, in rapid succession, and to be retained in the situs as a finished load bearing pile or column.

A particular object of the invention is to provide a new method and means for installing substantially any number of such concrete piles in an earth situs without being subject to delays, heretofore commonly caused by unavailability of fluid cement mortar at the situs about the time workmen are ready to start drilling.

Another object of the invention is to provide a pile-forming auger shell in preformed shell sections which, prior to assembly to form a workable auger, can be compactly nested one within another for economical storage and/or shipping purposes.

To the accomplishment of the forgoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
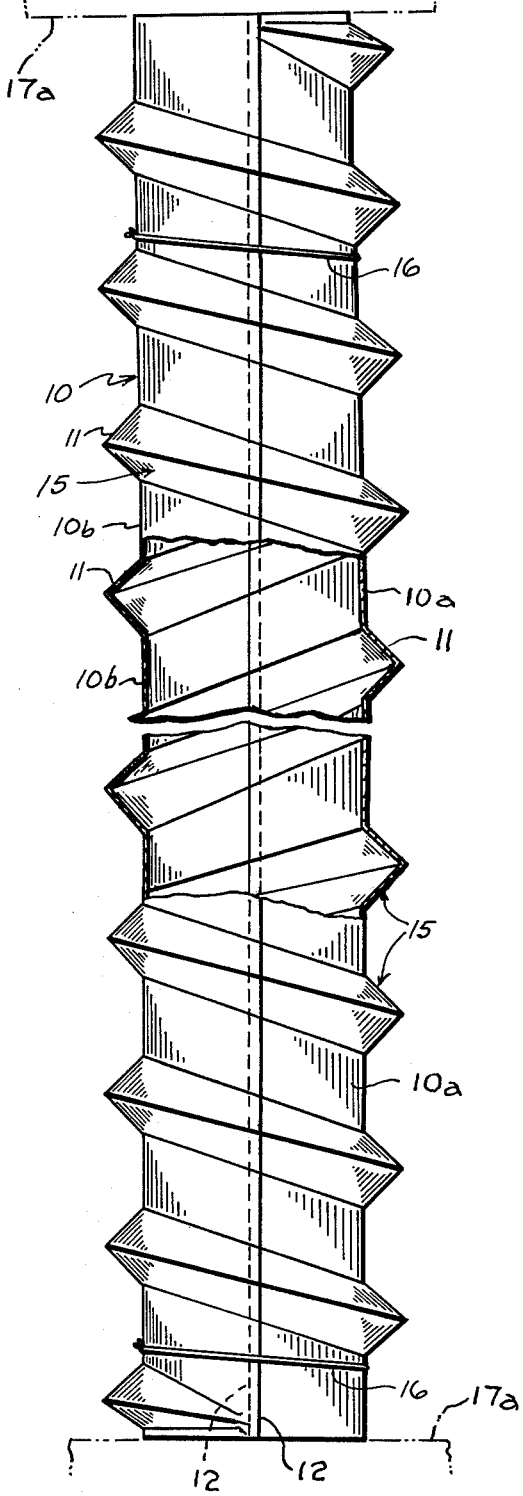
FIG. 1 is a composite side elevation, partly broken away, illustrating an assembled auger shell of the invention including mating half parts secured together, as by wire loops, to form a hollow spiral flighted auger shaft in accordance with the invention.
Figure 2:
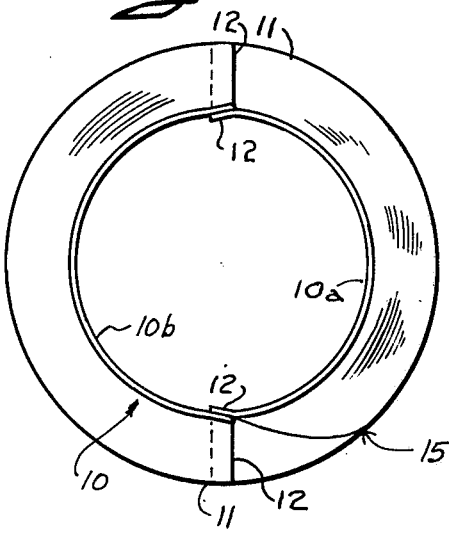
FIG. 2 is a top plan view, on an enlarged scale, of the assembled auger shell unit shown in FIG. 1, further illustrating one way that the mating shell halves can be complementally joined and secured together to form an auger shell of predetermined length.
Figure 3:
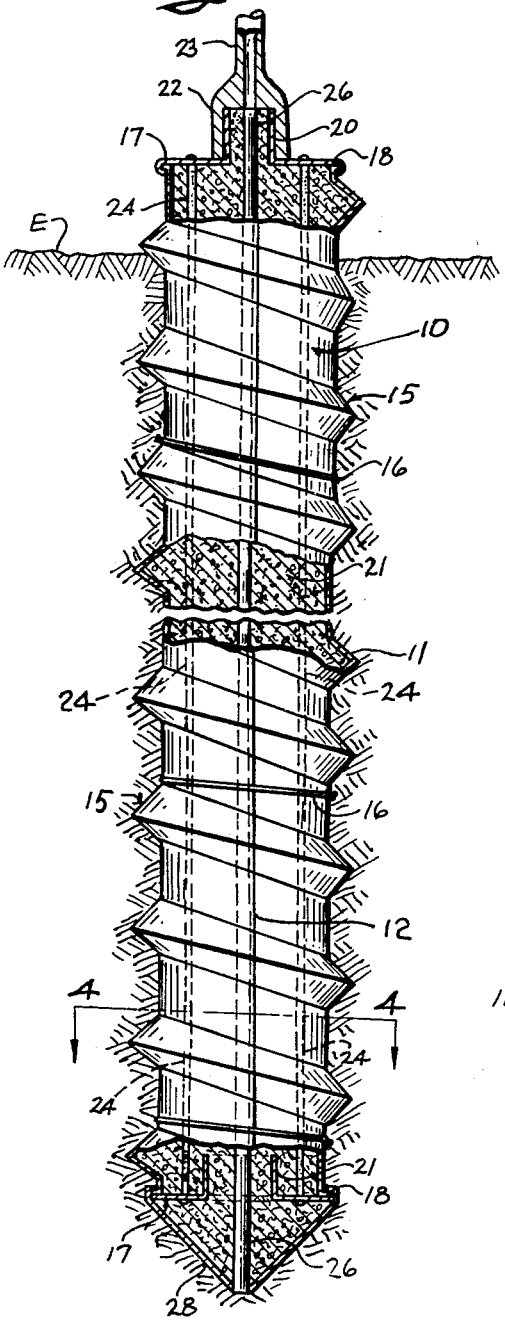
FIG. 3 is a view, on a reduced scale, illustrating the assembled auger shell of FIG. 1 with the ends thereof capped, but with the capped shell prefilled with self-hardenable cementitious material, and thereby to serve as an earth-drilling auger which has been drilled into the earth situs to be retained therein as a load-bearing pile.
Figure 5:
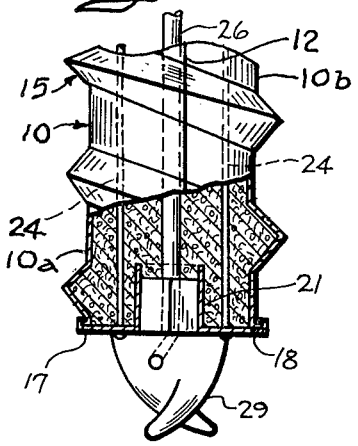
FIG. 5 is a view corresponding to the lower portion of FIG. 3, but illustrating use of a modified form of drill bit affixed to the lower end of the pile forming shell.

Referring to FIGS. 1 to 4 in general, and to FIGS. 1 and 2 in particular, FIG. 1 illustrates an elongated tubular auger shell or shaft 10, initially formed in two complemental shell halves 10*a* and 10*b*, of given axial shell length, as by means of known metal stamping equipment (not shown), thereby to have oppositely angled, mating hollow protrusions 11, 11, adapted complementally to connect and overlap along diametrically opposite edge portions 12, 12 of the assembled shell 10, and to form hollow spiral protrusions 11 as best shown in FIGS. 1 and 2. The assembled shell 10 can be of any given unit length and other dimensions, with the connecting protrusions 11 of the mated shell halves 10*a* and 10*b* defining continuous spiral flighting 15. In other words, the shell halves 10*a* and 10*b* may be secured together, in mating relationship as described, to form a spiral-flighted auger shell 10 of given unit length and other dimensions, as by means of looped wires or bands 16, 16 (See FIG. 1), or by other suitable means such as welding. Each end of the assembled shell unit 10 may have a closure plate or disc 17 suitably affixed thereto, as by crimping edges of the respective plates around integral lugs 18, 18 of the end edges of the tubular shell halves 10*a* and 10*b*, as shown in FIGS. 3 and 5.

The opposite end disc plates 17 of the shell units 10 may be of suitable types formed, as best shown in FIG. 3, with integral outwardly and inwardly extending collars 20 or 21, of squared cross-section, so proportioned and shaped that they can be non-rotatably connected with various driving or driven means, to be described later. FIG. 5, for example, illustrates how the hollow collar 21 of the inner plate 17 may be used to attach a drill bit 29 to an auger shell unit 10 of FIGS. 1 and 2. Moreover, a protruding squared collar 20 at the outer end of the auger unit 10 may be adapted for reception in a socket 22 on a power-driven shaft 23, for rotation of the completed auger shell unit, for drilling purposes, in a manner to be described later (see FIG. 3).

Figure 4:
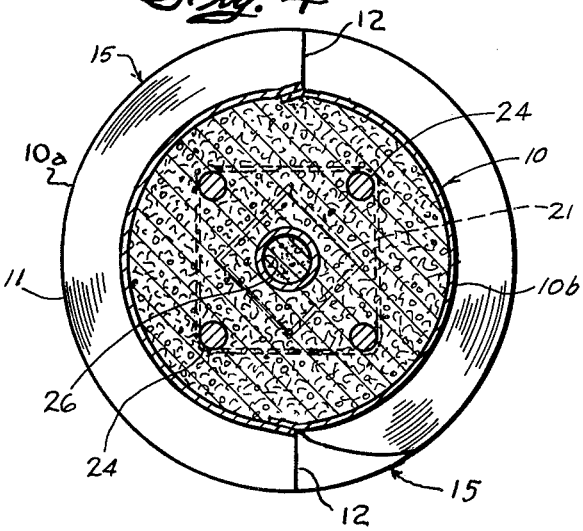
FIG. 4 is an enlarged cross-section of the combination auger and load-bearing pile, taken on the line 4—4 of FIG. 3.
Figure 6:
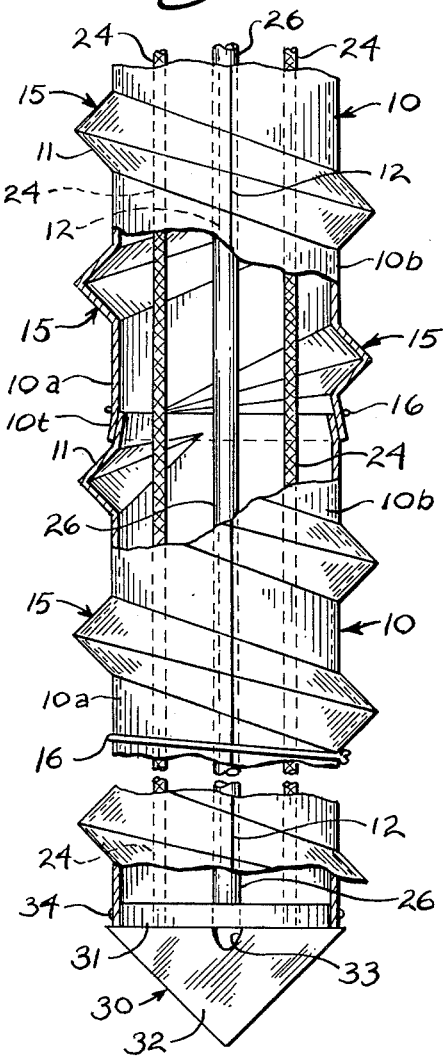
FIG. 6 is a view corresponding to a lower extent of the pile forming shell of FIG. 3, but illustrating use of at least two assembled auger shell sections affixed end-to-end, and ready for being filled with the self-hardenable cementitious material, and also illustrating use of a modified, one-piece end cap and drill bit.
Figure 7:
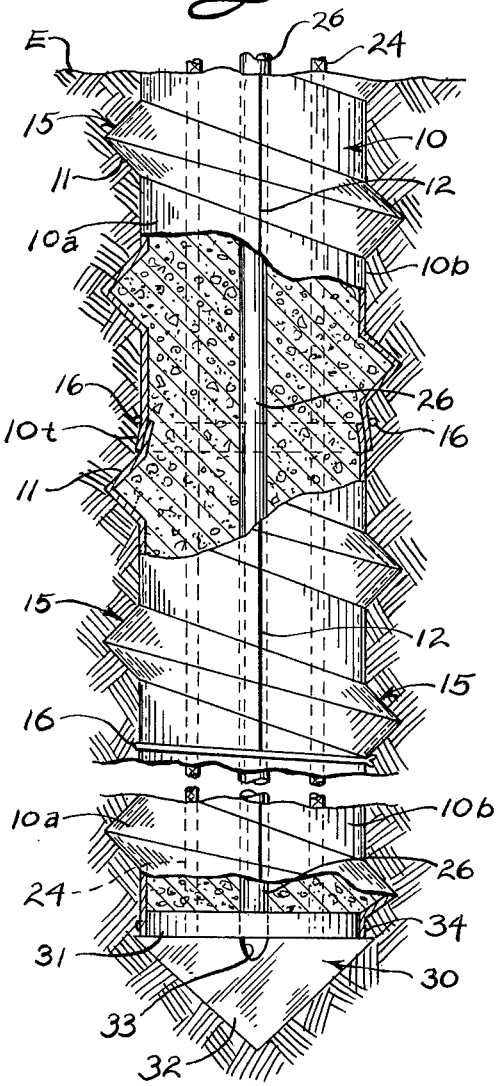
FIG. 7 is a view corresponding to FIG. 6, illustrating the assembled auger shell thereof filled with hardenable cementitious material, and subsequently being augered into the earth of a situs to serve as a load-bearing pile or column.

When only a single auger shell unit 10 is required, as for installing a pile column in an earth situs, the two end plates 17 may first have elongated reinforcing rods or elements 24, 24 affixed thereto, as by welding means, rigidly to extend within the hollow shell, between the end plates, as shown in FIGS. 3 and 4. If two or more such shell units 10 are required to be fixedly connected together, as shown in FIGS. 6 and 7, in conjunction with FIGS. 3 and 4, rods 24, 24 may be welded to inner and outer end plates 17. The rods 24 may be individually installed as described, or connected by wire or other means in the form of a cage-like reinforcing or post-tensioning structure.

The hollow auger unit 10 in FIGS. 1 and 2, so provided with tension rods 24 affixed therein between end plates 17, may while resting lengthwise on the ground, for example, have self-hardening, cement mortar supplied through one or other of the collars 20 and 21 at the exposed ends of the hollow auger shell 10, until the entire auger shell is solidly filled with pressurized cement mortar end to end. For this purpose the capped shell 10 may be suitably backed or clamped between fixed backing means 17*a*, 17*a* indicated by chain-dotted lines in FIG. 1, while the cement mortar is pumped into the shell in a manner calculated to post-tension the rods 24. Upon eventual hardening of the cement mortar the resultantly post-tensioned reinforcing rods 24 will be solidly embedded therein.

If required, or necessary, a jetting fluid or like conduit 26 may be positioned through the auger shell, prior to pumping in the cement mortar as described, as shown in FIGS. 3 and 4, as for supplying jetting water or other fluid material through the auger for known purposes. For this use the conduit 26 also may be suitably affixed to a hollow tapered head 28 on the inner end of the auger unit 10, as shown in FIG. 3, or to a suitable drill bit 29 as shown in FIG. 5.

FIG. 7 illustrates a combination auger and pile body installed in the earth situs E. The installed pile body of FIG. 7 is of substantially the same construction as the pile body 10 of FIG. 3, except that the shell 10 consists of two or more longitudinal shell sections, telescoped one within the other to a short extent, as indicated at 10*t* in FIGS. 6 and 7, and affixed to each other by suitable means, such as a wire band 16, or by welding. FIG. 6 illustrates the sectional shell 10 of FIG. 7, as initially assembled, ready for filling the same with self-hardening, hydraulic cement mortar of like cementitious material as described above.

In the FIGS. 6 and 7 construction, the auger and pile forming shell is illustrated as utilizing a modified form of driving bit 30 which includes a disc-like closure plate 31, adapted to be readily secured within the inner end of the tubular shell, as by use of screws 34, 34, and may have an integral axially protruding V-shaped plate 32 extended crosswise of the end of the shell to serve as a drilling point and stop member. The jetting pipe 26 may be threaded to the plate 31 for passage of jetting fluid through an opening 33 in the plate to the exterior of the driving bit.

Practice of the method of the present invention, for certain purposes, presupposes assembling or otherwise furnishing at the situs, in advance, one or more hollow auger shell units 10, as shown in FIGS. 1 and 2, and of predetermined lengths as required, with driving heads and drill bits incorporated therein as described above, and otherwise as needed for variable uses. For most economical use of the novel method of the invention any required number of such hollow auger shell units 10, as shown in FIGS. 1 and 2, for example, may be laid lengthwise on the ground conveniently adjacent to an area in which the piles are to be installed, and then separately pumped full of fluid, self-hardenable cementitious material, as previously described (See FIGS. 6, for example). This makes for economical and efficient use of both maerial and equipment since all of a very substantial number of hollow auger assemblies can be so filled with concrete and made ready for drilling the same into an earth situs, one after the other and without costly delays previously encountered, for example, when concrete supply trucks were not readily available when needed.

With a predetermined number of the assembled shell units 10 of FIG. 1, duly capped and filled with cementitious material, the same may be successively connected to the leads of a drilling rig supporting an auger drive socket 22 of the power driven shaft 23, as shown in FIG. 3. With rotation of the shaft 23 each said filled auger shell may be drilled into the earth situs E to required depth, as shown in either of FIGS. 3 or 7. If necessary, as for drilling into relatively hard soil, concrete filled shells may be drilled into predrilled auger cavities of diameter equal to or smaller than the tubular auger shell. If necessary or desirable jetting fluid, such as water under pressure, may be supplied from a suitable source, not shown, through the central pipe 26 while the auger is rotated into the earth. Moreover, the pipe 26 subsequently may be filled with self-hardenable fluid cementitious material further to increase the load-carrying strength of the finished pile or piles, as shown in FIG. 4. In any event it is desirable that the auger-pile flighting 11, when drilled to predetermined full axial depth, shall be firmly and anchoringly embedded or packed radially into the earth of the situs E, as shown in FIGS. 3, 5 and 7, thereby to increase or at least materially enhance the load-bearing capacity of each respective installed auger-pile.

It is readily apparent that, by use of the above-described novel method and means of present invention, substantially any number of preformed concrete piles made ready at the situs E, in advance as described above, can be drilled into the situs one next to another in continuous succession, for example, and without the long, frequent delays usually experienced in use of prior methods in which the concrete was pumped into augered cavities simultaneously with withdrawal of a cavity forming auger. Moreover, the simple nature of sectional auger-shell 10, as best illustrated in FIGS. 1 and 2, makes possible the economical use of light-weight shell metal, on ther order of 22 gauge steel, for stamping out the shell sections. The assembled metal shell 10, however, should be self-supportingly rigid in order to retain its given operative shape upon being filled with fluid cement mortar, as described above.

Among the many advantages of the above-described pile forming method and means, it is important to note that the improved auger, including the assembled shell 10 filled with hardened concrete can be drilled directly into exceptionally soft earth or so-called no-blow count materials of a situs, thereby to avoid the usual procedure of driving a tubular casing through such soft earth and then augering through the soft earth thereby contained within the driven casing.

Modifications of the invention may be resorted to without departing from the spirit thereof or the scope of the appended claims.

The embodiments of the invention in which an exclusive property or privilege is claimed are defined as follows:

1. A device for producing a pile in an earth situs comprising; an elongated tubular shell of self-supportingly rigid material, formed with outwardly protruding hollow spiral flighting along the same; said shell, including said hollow flighting, being adapted to be filled with solid load-supporting material, whereby the filled tubular shell can be drilled into an earth situs and retained therein as a solid load supporting pile, said formed tubular shell including complementally connecting half shell parts adapted to be produced in quantity for nesting like half shell parts compactly stacked one within another for subsequent assembly and use for producing piles.

2. The device of claim 1 wherein said elongated tubular shell has closure means affixed to opposite ends thereof for initially retaining fluid, self-hardenable cementitious material within said shell including said hollow flighting.

3. The device of claim 2 further including means for retaining said half shell parts together to form said hollow flighted shell.

4. The device of claim 1 further including means for retaining said half shell parts of said tubular shell together for subsequent assembly and use for producing piles.

5. The device of claim 4 wherein said tubular shell with said half tubular shell parts are retained together in tubular form, containing a hardened load-bearing cementitious material, and serving as a load bearing column upon being drilled into the earth situs.

6. The device of claim 5 wherein one of said opposite end closure means on said tubular shell includes means for attachment to power operated drilling means, and the other opposite said end closure means has a drill bit affixed thereon.

7. The device of claim 2 wherein one of said end closure means on said tubular shell includes thereon means for attachment of said shell to a power drilling means, and the opposite said end closure means has a drill bit thereon.

8. The device of claim 1 which includes a plurality of said tubular shell extents secured to each other at axially adjoining ends.

9. The device of claim 2 wherein a plurality of said tubular shells are secured to each other at adjoining ends thereof.

10. The device of claim 9 wherein said adjoining ends of said tubular shells are telescopically connected.

11. The device of claim 1 wherein said tubular shell has a conduit extending through the same as for selective passage therethrough of a jetting fluid.

12. The device of claim 11 wherein said conduit extends centrally through said tubular shell as for passage of fluid through said shell.

13. The device of claim 2 wherein one of said end closure means has an outwardly extending collar thereon for connection to a driving means, and the other of said end closure means has an inwardly extending collar thereon for attachment of a drill bit thereto.

14. The device of claim 2 further comprising elongated reinforcing means contained within said shell.

15. The device of claim 14 wherein said elongated reinforcing means has opposite ends affixed to said opposite end closure means.

16. The device of claim 6 wherein said tubular shell has a conduit extending through the same as for passage of fluid through said shell, said drill bit having a plate with an opening therethrough in alignment with said conduit for passage of such fluid through said flight to the exterior of said drill bit.

17. A method of producing a pile in an earth situs utilizing an elongated hollow tubular casing unit of self-supportingly rigid material having outwardly protruding hollow spiral flighting along the same, comprising the steps of filling the hollow tubular casing unit with self-hardenable cementitious material, while maintaining exposed ends of the same closed to contain the cementitious material prior to inserting the tubular casing unit into the earth, allowing the cementitious material to harden within the tubular casing unit, then drilling the thus filled tubular casing unit into the earth to define a pile cavity of predetermined depth, with drilled earth anchoringly retained along and around the flighting, and leaving the drilled casing with hardened cementitious material therein in such cavity as part of the pile.

18. The method of claim 17 further comprising the steps of assembling and securing together preformed mating half tubular shell parts of requisite axial extent to form such hollow tubular casing unit with hollow spiral flighting formed therein.

19. The method of claim 17 wherein a plurality of such hollow tubular casing units are secured together to form a composite casing unit which is filled with such self-hardenable cementitious material and allowed to harden therein prior to drilling the thus filled tubular casing unit into the earth as aforesaid, each of said hollow tubular casing units including complementally connecting half shell parts connected together.

20. The method of claim 17 wherein prior to the step of filling the hollow tubular casing unit with self-hardenable cementitious material and drilling such tubular casing unit into the earth, closure means are affixed to the opposite ends of such tubular casing unit for initially retaining such cementitious material in such tubular casing unit including the hollow flighting thereof during such filling step, and elongated reinforcing means are placed in such tubular casing unit and the opposite ends of such elongated reinforcing means are affixed to such opposite end closure means.

21. The method of claim 17 wherein such tubular casing unit has a conduit extending through the same, further comprising the step of pumping jetting fluid through such conduit to assist in drilling such tubular casing unit into the earth during such drilling step, and filling such conduit with cementitious material after the drilling step.

22. The method of claim 17 wherein a plurality of such hollow tubular casing units are filled with such fluid self-hardenable cementitious material at the situs prior to being drilled into the situs, thereby to facilitate installation of a succession of pile bodies at the situs in selective order, each of said hollow tubular casing units including complementally connecting half shell parts adapted to be produced in quantity for nesting like half shell parts compactly stacked one within another for subsequent assembly and use for producing such piles.

23. A pile in an earth situs, comprising an elongated hollow tubular casing unit of self-supportingly rigid material having outwardly protruding hollow spiral flighting along the same, said hollow tubular casing unit being filled with self-hardenable cementitious material and having closure means affixed to the opposite ends thereof to contain the cementitious material prior to hardening thereof, said cementitious material being hardened within said tubular casing unit, and said tubular casing unit with hardened cementitious material therein being drilled into the earth to define a pile cavity of predetermined depth, with drilled earth anchoringly retained along and around the flighting, and said drilled casing unit with hardened cementitious material therein being retained in such cavity as part of the pile, said closure means affixed to the upper end of said tubular shell including means for attachment to power operated drilling means, and said closure means affixed to the lower end of said tubular shell having a drill bit affixed thereon.

24. The pile of claim 23 further comprising elongated reinforcing means embedded within said hardened cementitious material within said tubular casing unit, said elongated reinforcing means having opposite ends which are affixed to said closure means at the opposite ends of said tubular casing unit.

25. The pile of claim 23 wherein said tubular casing unit has a conduit extending through said hardened cementitious material in said tubular casing unit as for selective passage therethrough of a jetting fluid.

26. The pile of claim 25 wherein said closure means affixed to the lower end of said tubular casing unit comprises a plate having an opening therethrough in alignment with said conduit for passage of such fluid through said conduit to the exterior of said plate, said drill bit being affixed to said plate.

* * * * *